US008568092B2

(12) United States Patent
Matsuyama

(10) Patent No.: US 8,568,092 B2
(45) Date of Patent: Oct. 29, 2013

(54) TURBOCHARGER

(75) Inventor: Yoshimitsu Matsuyama, Tokyo (JP)

(73) Assignee: IHI Corporation, Tokyo (JP)

( * ) Notice: Subject to any disclaimer, the term of this patent is extended or adjusted under 35 U.S.C. 154(b) by 512 days.

(21) Appl. No.: 12/673,129

(22) PCT Filed: Jul. 3, 2008

(86) PCT No.: PCT/JP2008/001750
§ 371 (c)(1),
(2), (4) Date: Feb. 11, 2010

(87) PCT Pub. No.: WO2009/022448
PCT Pub. Date: Feb. 19, 2009

(65) Prior Publication Data

US 2011/0182722 A1 Jul. 28, 2011

(30) Foreign Application Priority Data

Aug. 16, 2007 (JP) ..... 2007-212188

(51) Int. Cl.
*F01D 11/08* (2006.01)

(52) U.S. Cl.
USPC ..... 415/173.3; 415/174.2; 415/177

(58) Field of Classification Search
USPC ..... 415/170.1, 134, 173.3, 177; 277/451, 277/574
See application file for complete search history.

(56) References Cited

U.S. PATENT DOCUMENTS

| | | | | |
|---|---|---|---|---|
| 3,391,939 | A * | 7/1968 | Mueller | 277/384 |
| 5,074,111 | A * | 12/1991 | Harris et al. | 60/39.37 |
| 5,233,824 | A * | 8/1993 | Clevenger | 60/805 |
| 5,584,585 | A * | 12/1996 | Premiski et al. | 384/607 |
| 5,954,343 | A | 9/1999 | Sumida et al. | |
| 5,964,574 | A | 10/1999 | Meier et al. | |
| 6,076,835 | A | 6/2000 | Ress et al. | |
| 6,928,816 | B2 | 8/2005 | Leavesley | |
| 2003/0107188 | A1 | 6/2003 | Spence et al. | |
| 2004/0244372 | A1 | 12/2004 | Leavesley | |
| 2006/0127244 | A1 * | 6/2006 | Frankenstein et al. | 417/407 |
| 2006/0188368 | A1 | 8/2006 | Jinnai et al. | |
| 2007/0025841 | A1 * | 2/2007 | Milazar | 415/134 |
| 2008/0304957 | A1 | 12/2008 | Walter et al. | |

FOREIGN PATENT DOCUMENTS

| | | | |
|---|---|---|---|
| CN | 1192513 | A | 9/1998 |
| DE | 20 2005 009 491 | U1 | 9/2005 |
| DE | 10 2004 039 473 | A1 | 3/2006 |

(Continued)

OTHER PUBLICATIONS

U.S. Appl. No. 12/743,966, filed May 20, 2010, Matsuyama.

(Continued)

*Primary Examiner* — Nathaniel Wiehe
*Assistant Examiner* — Justin Seabe
(74) *Attorney, Agent, or Firm* — Oblon, Spivak, McClelland, Maier & Neustadt, L.L.P.

(57) ABSTRACT

A turbocharger including a sealing device for prevention of fluid leakage from high to low pressure sides through a radially extending annular gap formed between a shroud and a shroud-confronting portion which constitute the turbocharger is provided. The sealing device includes a frustoconical disc spring seal member arranged in a pressed manner in the gap between the shroud and the shroud-confronting portion. Accordingly, fluid leakage from high to low pressure sides through an annular gap formed between constructional members of a turbocharger and extending radially of a turbine shaft may be prevented.

3 Claims, 9 Drawing Sheets

(56) References Cited

FOREIGN PATENT DOCUMENTS

| | | | |
|---|---|---|---|
| EP | 1 515 003 | A1 | 3/2005 |
| EP | 1 691 034 | A2 | 8/2006 |
| GB | 2 382 851 | A | 6/2003 |
| GB | 2 427 446 | A | 12/2006 |
| JP | 63 040538 | | 3/1988 |
| JP | 9 112697 | | 5/1997 |
| JP | 11 229886 | | 8/1999 |
| JP | 2000-161137 | | 6/2000 |
| JP | 2006-125588 | | 5/2006 |
| WO | WO 98/53228 | A1 | 11/1998 |
| WO | WO 2006/133793 | A1 | 12/2006 |

OTHER PUBLICATIONS

U.S. Appl. No. 12/745,351, filed May 28, 2010, Matsuyama, et al.
U.S. Appl. No. 12/863,055, filed Jul. 15, 2010, Matsuyama, et al.
Search Report issued Apr. 17, 2012, in European Patent Application No. 08776762.
U.S. Appl. No. 13/517,487, filed Jun. 20, 2012, Matsuyama.

* cited by examiner

TURBOCHARGER

TECHNICAL FIELD

The present invention relates to a turbocharger with a sealing device for prevention of fluid leakage from high to low pressure sides through an annular gap formed between structural members of the turbocharger and extending radially of a turbine shaft.

BACKGROUND ART

FIG. 1 shows an example of a conventional variable capacity turbocharger to which the invention may be applied. The turbocharger comprises turbine and compressor housings 1 and 2 integrally assembled through a bearing housing 3 by connecting bolts 3*a* and 3*b*. A turbine impeller 4 in the turbine housing 1 is connected to a compressor impeller 5 in the compressor housing 2 by a turbine shaft 7 rotatably supported in the bearing housing 3 by a bearing 6. As best shown in FIG. 2 showing section A in FIG. 1 in enlarged scale, the bearing housing 3 is provided, at its turbine housing side, with a shroud 10 comprising plates 9*a* and 9*b* between which a plurality of vanes 9 are annularly arranged for guiding into the turbine impeller 4 fluid (exhaust gas) to be guided to a scroll passage 8 of the turbine housing 1, the shroud being sandwiched by the turbine and bearing housings 1 and 3 and secured by the bolt 3*a*. In FIG. 1, reference numeral 11 denotes a positioning pin for assembly of the shroud 10; and 12, a scroll passage in the compressor housing 2. Reference numerals 13*a*, 13*b*, 13*c* and 13*d* designate a linked transmission mechanism for control of opening angle of the vanes 9.

The turbine housing 1 formed with the scroll passage 8 has a portion 14 confronting the shroud 10, an annular gap 15 being formed between the shroud 10 and the shroud-confronting portion 14 and extending radially of the turbine shaft 7 into the scroll passage 8. The turbine-housing-side plate 9*a* constituting the shroud 10 has an extension 17 extending along the turbine impeller 4 toward a notch 16 on an inner periphery of the shroud-confronting portion 14. Thus, the gap 15 extends between the extension 17 and the notch 16 in a direction away from the bearing casing to provide a gap 15' opening into the inner periphery of the shroud-confronting portion 14.

In FIG. 1, the shroud 10 is provided, at its bearing housing 3 side, with a heat shield plate 18 which is arranged backward of the turbine impeller 4 and is fixed to the plate 9*b* of the shroud 10. Further, the bearing housing 3 is formed with a portion 19 confronting the heat shield plate 18, a gap 20 being provided between the heat shield plate 18 and the heat-shield-plate-confronting portion 19 and extending radially of the turbine shaft 7.

By nature, the gaps 15 and 20 are unwanted; however, they are provided for countermeasure to, for example, possible thermal deformation of the turbine housing 1 between during being hot and during being cold and possible accuracy dispersion of parts to be assembled.

However, the gaps 15 and 20 may disadvantageously cause gas leakage therethrough from high to low pressure sides, leading to problems such as greatly varied performance at lower pressure side of the turbocharger and resultant unstable engine performance.

In order to overcome the problems, it has been proposed to arrange sealing piston rings in the gap 15' between the inner peripheral notch 16 on the shroud-confronting portion 14 and the extension 17 of the shroud 10 so as to prevent the gas leakage and absorb thermal deformation (see Reference 1).

[Reference 1] JP 2006-125588A

SUMMARY OF THE INVENTION

Problems to be Solved by the Invention

In Reference 2, as shown in FIG. 2, a sealing device is provided by inserting in general two sealing piston rings 22 into an annular groove 21 on an outer periphery of the shroud 10; outer peripheries of the piston rings 22 are pressed against the inner periphery of the notch 16 by spring force of the piston rings themselves so as to prevent the gas leakage.

However, even if the piston rings 22 are arranged in the gap 15' so as to prevent gas leakage as mentioned in the above, the prevention of the gas leakage is limitative. More specifically, as shown in FIG. 3, the piston ring 22 requires an opening 23 between butt ends and therefore cannot constitute a completely continuous ring; even if the two sealing piston rings 22 are arranged with their openings 23 being offset, gas may leak through the openings 23.

Moreover, even if the notch 16 on the inner periphery of the shroud-confronting portion 14 is machined with high degree of roundness, slight deviation in roundness of the piston ring 22 may result in failure of the same being pressed against the inner periphery of the shroud-confronting portion 14 with uniform pressing force, leading to gas leakage through the outer periphery of the piston ring 22.

Also the gap 20 between the heat shield plate 18 and the heat-shield-plate-confronting portion 19 may cause gas leakage therethrough. There have been no means for effectively preventing the gas leakage through the gap 20.

The invention was made in view of the above and has its object to provide a turbocharger with a sealing device for prevention of fluid leakage from high to low pressure sides through an annular gap formed between structural members of the turbocharger and extending radially of a turbine shaft.

Means or Measures for Solving the Problems

The invention is directed to a turbocharger with a sealing device for prevention of fluid leakage from high to low pressure sides through an annular gap formed between first and second members constituting the turbocharger and extending radially of a turbine shaft, characterized in that said sealing device has a disc spring seal member which is frustoconical and is arranged in the gap between said first and second members so as to be pressed against said first and second members.

It is preferable in the above-mentioned turbocharger that the first and second members are a shroud fixed to the bearing housing and a shroud-confronting portion formed on the turbine housing, respectively, with the gap therebetween, inner and outer peripheral ends of said seal member being pressed against the shroud-confronting portion and the shroud, respectively.

Alternatively, it is preferable in the above-mentioned turbocharger that said sealing device has an annular projection protruding further from an inner edge of an end face of said shroud-confronting portion, the inner peripheral end of said seal member being fitted with an outer periphery of said projection and being pressed against the end face of the shroud-confronting portion, the outer peripheral end of the seal member being pressed against the shroud.

Alternatively, it is preferable in the above-mentioned turbocharger that the outer periphery of said projection is formed with a portion with increased diameter toward an tip end, the inner peripheral end of said seal member being pressed against the projection owing to said increased diameter portion.

Alternatively, it is preferable in the above-mentioned turbocharger that an annular step is formed on an inner periphery of said shroud-confronting portion, a riser portion formed at the inner peripheral end of the seal member being pressed against said step, the outer peripheral end of the seal member being pressed against the shroud.

Alternatively, it is preferable in the above-mentioned turbocharger that said first and second members are a heat shield plate fixed to said shroud and a heat-shield-plate-confronting portion formed on the bearing housing, respectively, with the gap therebetween, one of inner and outer peripheral ends of said seal member being pressed against the heat-shield-plate-confronting portion, the other being pressed against the heat shield plate.

Alternatively, it is preferable in the above-mentioned turbocharger that the inner peripheral end of said disc spring seal member is pressed against the outer periphery of an annular projection formed on the heat-shield-plate-confronting portion.

Effects of the Invention

A turbocharger of the invention, which has a frustoconical disc spring seal member arranged in an annular gap formed between first and second members of the turbocharger and extending radially of a turbine shaft, said seal member being pressed against the first and second members, can exhibit an excellent effect or advantage that a problem of fluid leakage through the gap can be effectively prevented.

EXPLANATION OF THE REFERENCE NUMERALS

Figure 1:
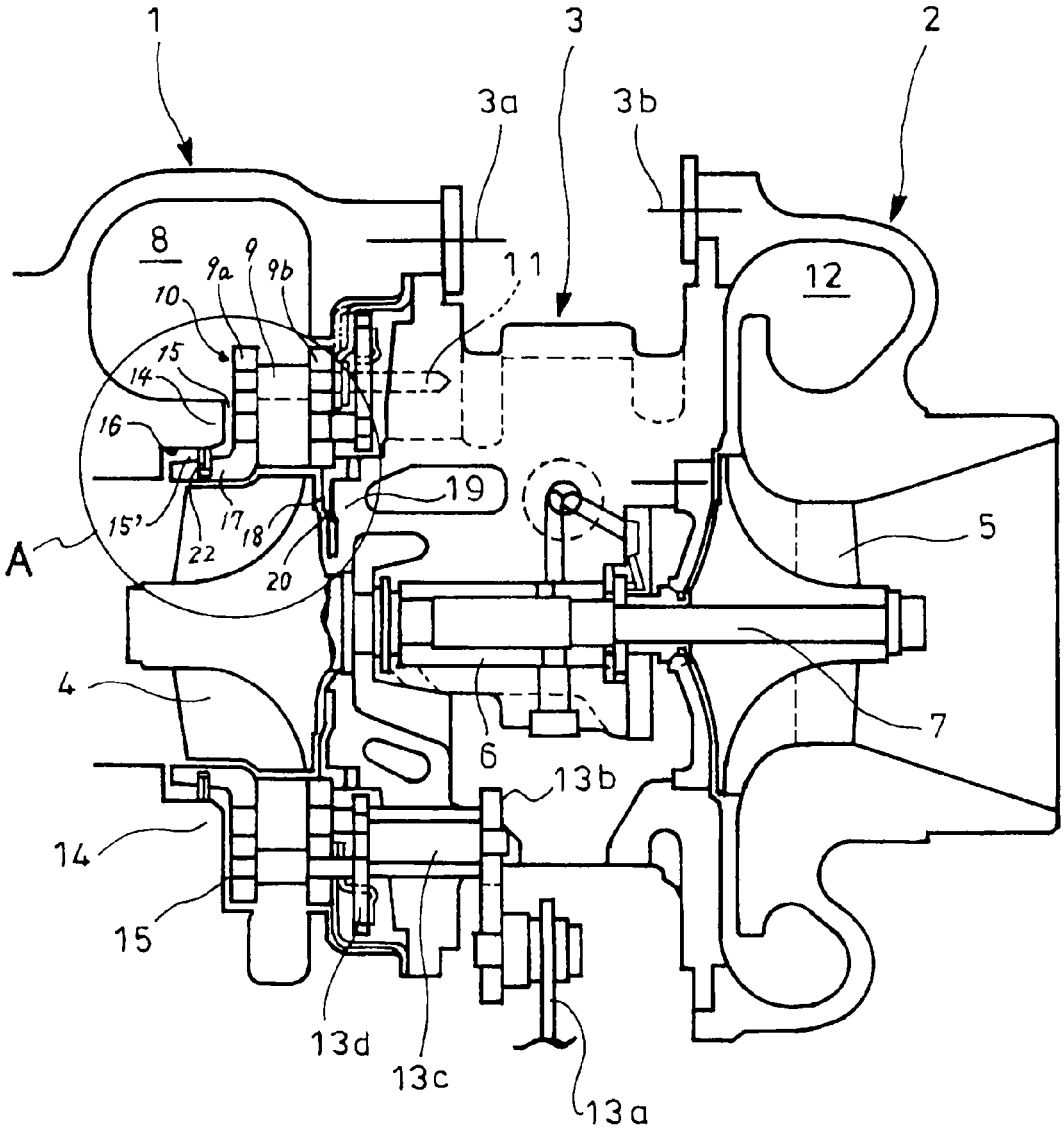
FIG. 1 Background Art
FIG. 1 is a sectional view showing an example of a conventional variable capacity turbocharger to which the present invention may be applied.
Figure 2:
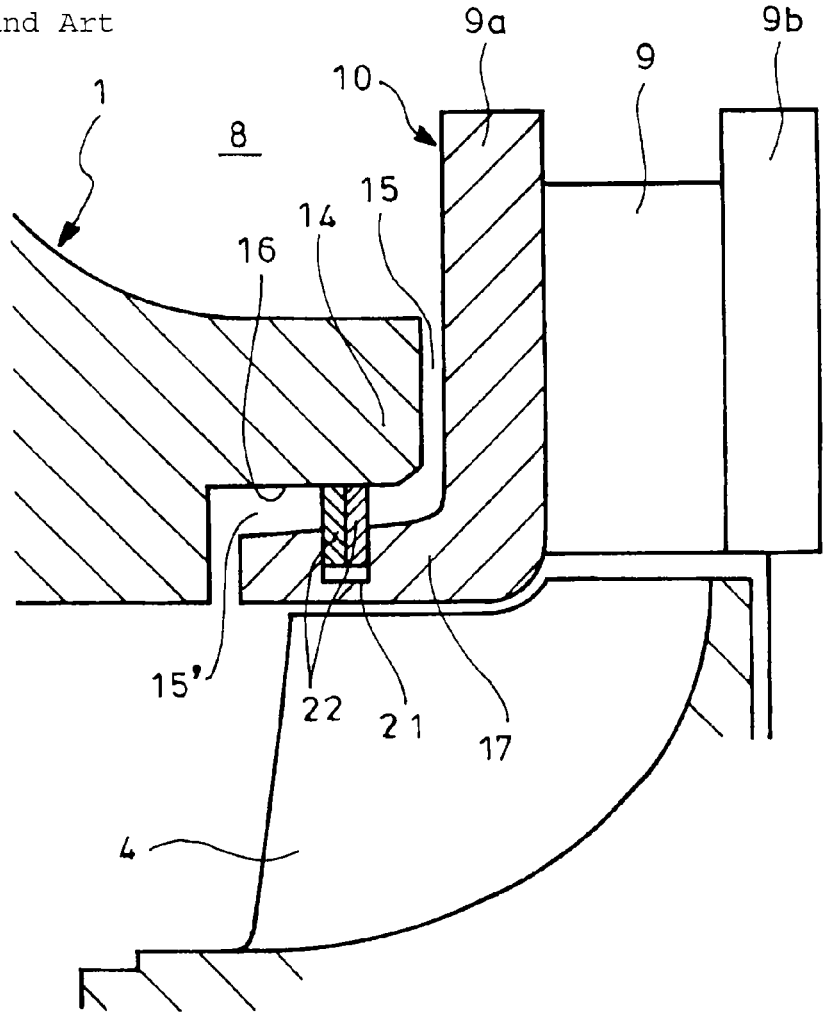
FIG. 2 Background Art
FIG. 2 is a sectional view showing a conventional sealing device in the form of a sealing piston ring between an extension on a shroud and an inner periphery of a shroud-confronting portion in section A of the turbocharger shown in FIG. 1.
Figure 3:
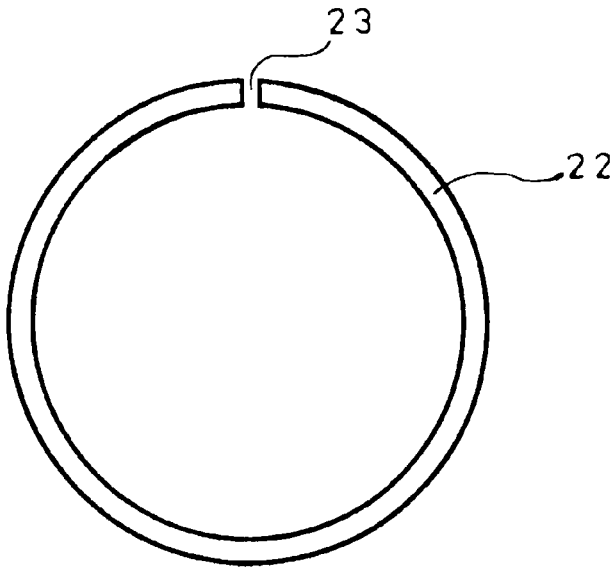
FIG. 3 Background Art
FIG. 3 is a front view of the piston ring.

1 turbine housing
10 shroud (first member)
14 shroud-confronting portion (second member)
14*a* end face
15 gap
18 heat shield plate (first member)
19 heat-shield-plate-confronting portion (second member)
19*a* end face
20 gap
24 disc spring seal member
25 inner peripheral end
26 outer peripheral end
27 annular projection
28 increased diameter portion
36 riser portion
37 annular projection

BEST MODE FOR CARRYING OUT THE INVENTION

Embodiments of the invention will be described in conjunction with the attached drawings.

Figure 4:
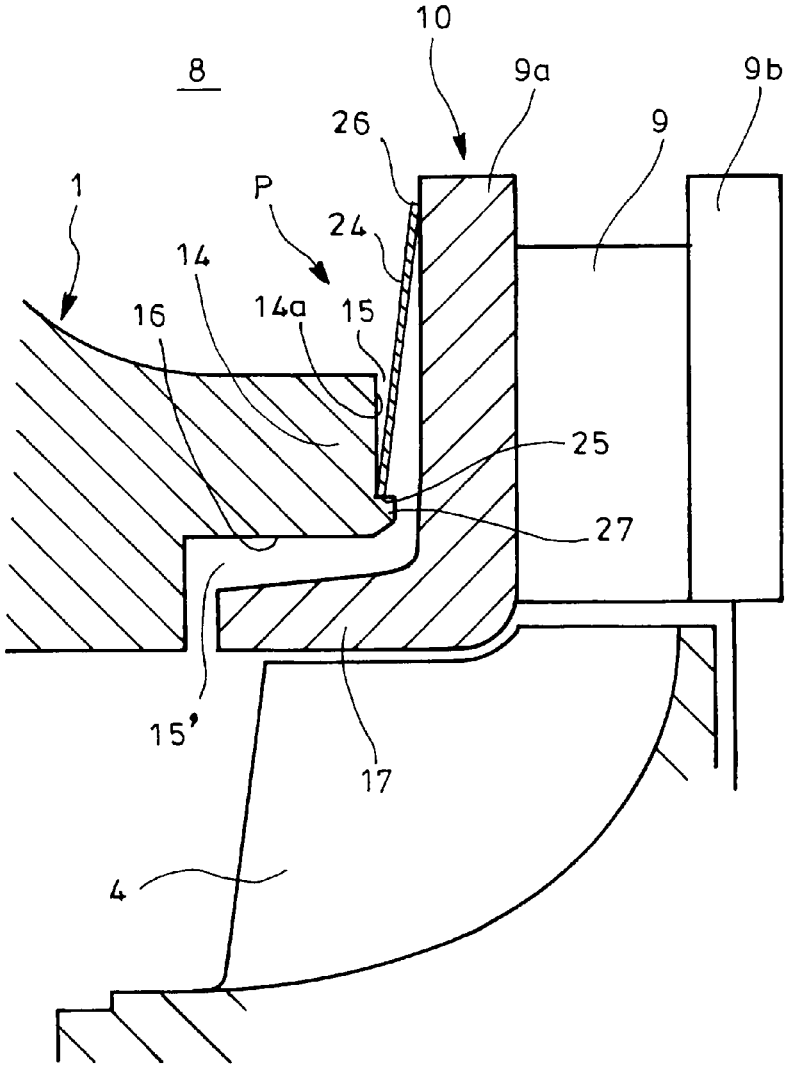
FIG. 4 is a sectional view showing an embodiment of the invention applied to the gap between a shroud (first member) and a shroud-confronting portion (second member) in section A of the turbocharger shown in FIG. 1.

FIG. 4 shows an embodiment of the invention applied to a gap 15 between a shroud 10 (first member) fixed to a bearing housing 3 and a shroud-confronting portion 14 (second member) formed on a turbine housing 1 in section A of FIG. 1.

Figure 5:
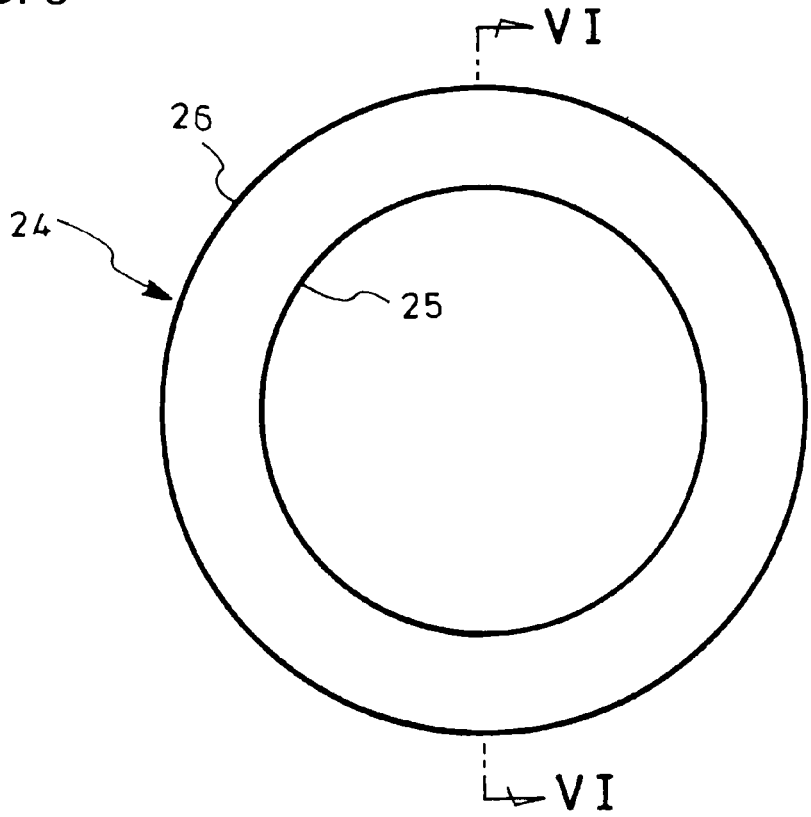
FIG. 5 is a front view showing an embodiment of a disc spring seal member of the invention.
Figure 6:
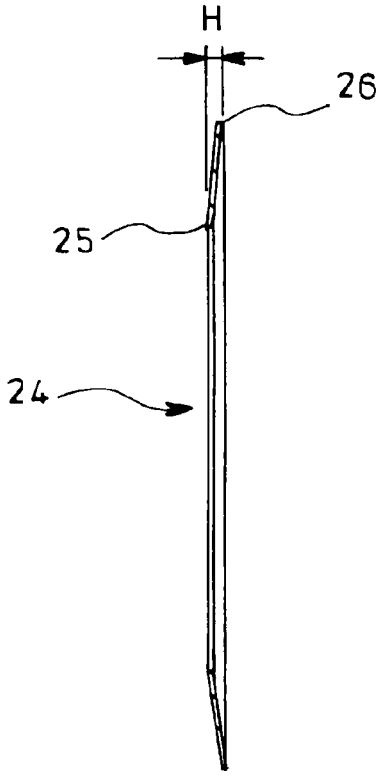
FIG. 6 is a view looking in the direction of arrows VI in FIG. 5.

In the invention, a sealing device comprises a disc spring seal member 24 made of spring material shown in FIGS. 5 and 6. The seal member 24 is frustoconical with its doughnut-shaped or annular inner and outer peripheral ends 25 and 26 being offset from each other with respect to the axis, height H of the frustoconical seal member 24 in the axial direction being greater than width of the gap 15.

The sealing device further comprises an annular projection 27 protruding further from an inner edge of an end face 14*a* of the shroud-confronting portion 14 as shown in FIG. 4, the inner peripheral end 25 of the seal member 24 being fitted with an outer periphery of the projection 27 to abut on the end face 14*a* of the shroud-confronting portion 14, the outer peripheral end 26 of the seal member 24 abutting on the shroud 10.

Mode of operation of the embodiment shown in FIGS. 4-6 will be described.

With the inner peripheral end 25 of the seal member 24 being fitted with the outer periphery of the projection 27 protruding from the inner edge of the end face 14*a* of the portion 14 shown in FIG. 4, the turbine housing 1 shown in FIG. 1 is integrally assembled with the bearing housing 3, using the connecting bolt 3*a*.

In this case, when the assembly is completed with the height H of the frustoconical seal member 24 in the axial direction being greater than the width of the gap 15, the inner and outer peripheral ends 25 and 26 of the seal member 24 are pressed against the end face 14*a* of the shroud-confronting portion 14 and the shroud 10, respectively. In this manner, with the inner and outer peripheral ends 25 and 26 of the seal member 24 being pressed against the end face 14*a* of the portion 14 and the shroud 10, respectively, the gap 15 is shut off so that the problem of gas in the higher-pressure-side scroll passage 8 leaking through the gap 15 into the lower pressure side can be effectively prevented.

Figure 7:
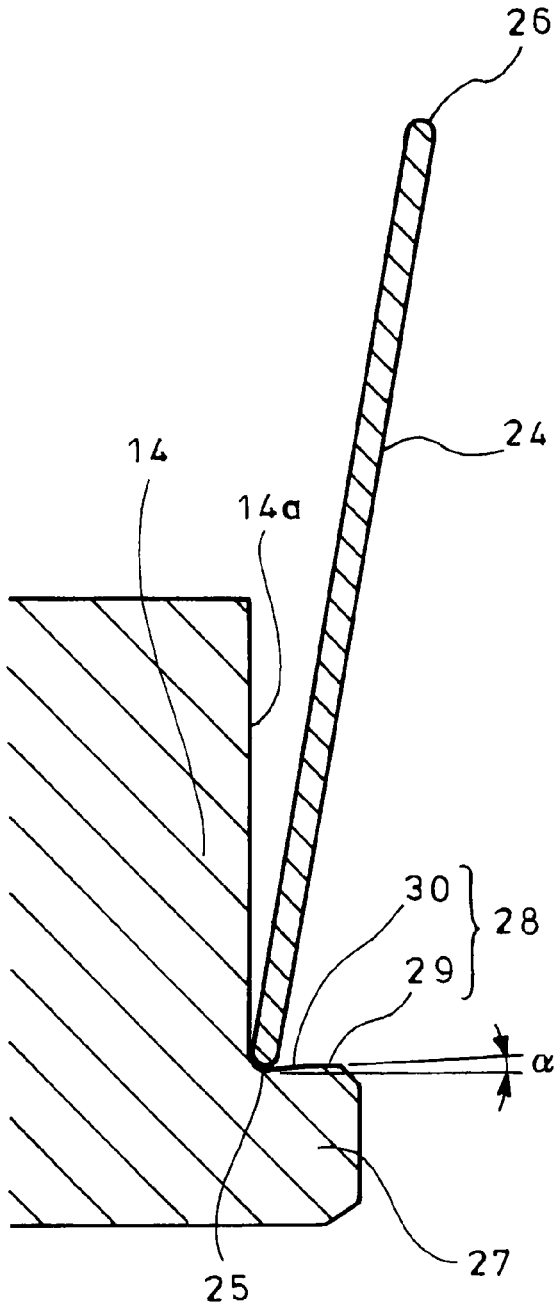
FIG. 7 is a sectional view showing a further embodiment of the seal member.

FIG. 7 shows a further embodiment of the seal member in which the outer periphery of the projection 27 is formed with a portion 28 with increased diameter toward a tip, the inner peripheral end 25 of the seal member 24 shown in FIGS. 5 and 6 is pressed against the projection 27 owing to the increased diameter portion 28. The increased diameter portion 28 comprises a flat portion 29 at the tip side of the projection 27 and in parallel with the axis and a slant 30 decreased in diameter from the flat portion 29 to the end face 14*a* of the shroud-confronting portion 14, an inclination angle α of the slant 30 being 5°-10° or so.

In the FIG. 7 embodiment, the seal member 24 is mounted with press-in of its inner peripheral end 25 against the increased diameter portion 28 of the annular projection 27, so that a problem that the seal member 24 is moved to drop off from the projection 27 upon assembling of the turbine housing 1 with the bearing housing 3 can be prevented.

Figure 8:
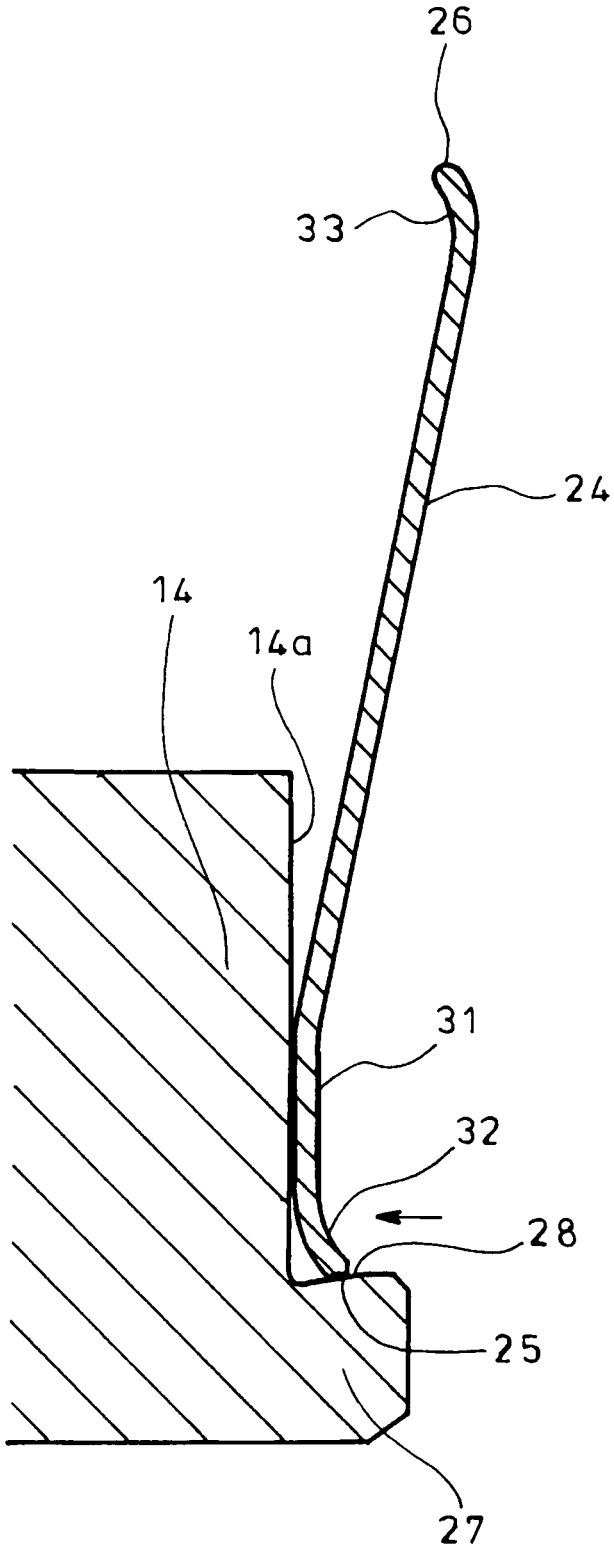
FIG. 8 is a sectional view showing a modification of the seal member shown in FIG. 7.
Figure 9:
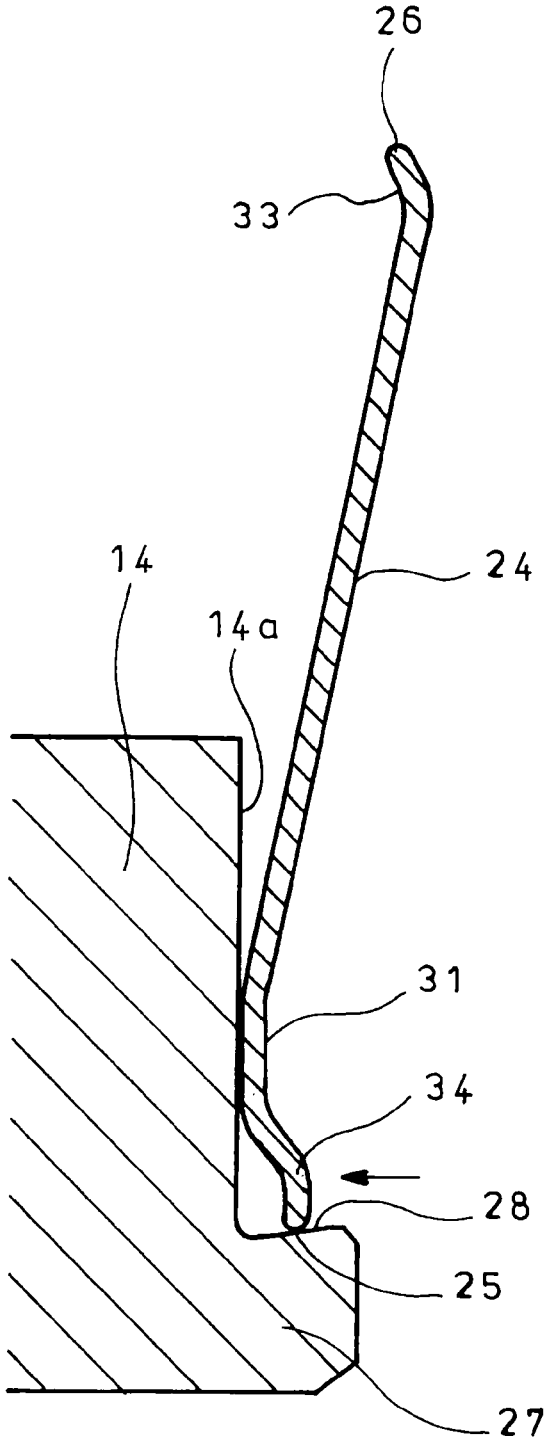
FIG. 9 is a sectional view showing a further embodiment of the seal member.

FIGS. 8 and 9 show modifications of the disc spring seal member 24 shown in FIG. 7. In FIG. 8, the seal member 24 has, at its position adjacent to the inner peripheral end 25, a vertically straight portion 31 along the end face 14*a* of the shroud-confronting portion 14 and has at its inner peripheral end 25 a portion 32 curved in a direction away from the end face 14*a* for easy press-in to the increased diameter portion 28 of the projection 27. The seal member 24 is provided at its outer peripheral end 26 with a curved portion 33 curved in a direction reverse to that of the curved portion 32 of the inner peripheral end 25 for uniform pressing against the shroud 10. If required for production of the seal member 24, the outer peripheral end 26 of the curved portion 33 may have an extension extending linearly and peripherally outwardly.

In FIG. 9, the curved portion 32 at the inner peripheral end 25 shown in FIG. 8 is replaced by a substantially S-shaped portion 34 which is constituted by curving the end of the straight portion 31 in the direction away from the end face 14*a* and the directing the same vertically toward the increased diameter portion 28.

According to the modification of FIG. 8 or 9, the curved portion 32 or the substantially S-shaped portion 34 formed at the inner peripheral end 25 is pressed against the increased diameter portion 28 of the projection 27, so that the problem of the seal member 24 being moved to drop off from the projection 27 can be prevented. Sealing is effected with two pressings, i.e., pressing in the form of press-in of the inner peripheral end 25 of the seal member 25 having the curved portion 32 or the substantially S-shaped portion 34 against the projection 27 and pressing of the straight portion 31 against the end face 14*a*, so that sealability is enhanced between the shroud-confronting portion 14 and the seal member 24. Moreover, provided at the outer peripheral end 26 of the seal member 24 is the curved portion 33 smoothly pressed against the shroud 10, so that the sealability between the shroud 10 and the seal member 24 is enhanced.

Figure 10:
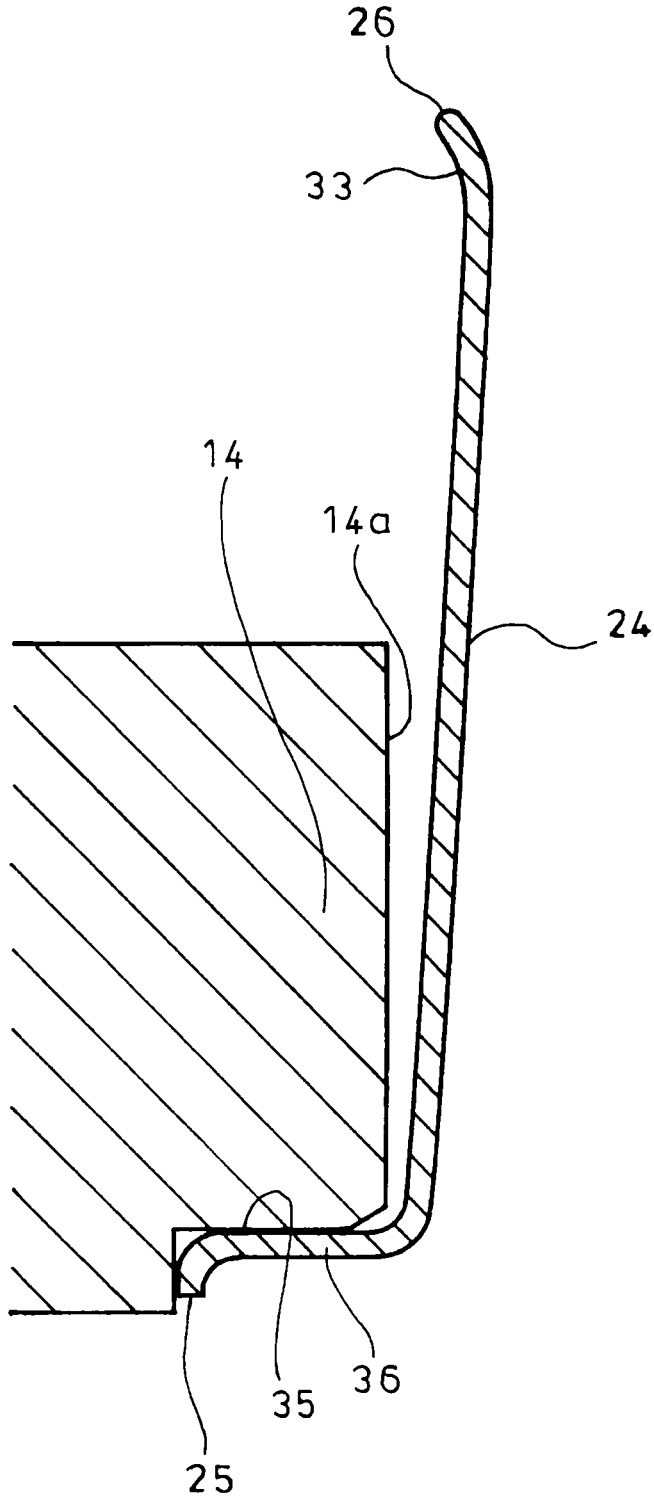
FIG. 10 is a still further embodiment of the seal member.

FIG. 10 shows a still further embodiment of the seal member in which an annular step 35 is formed on an inner periphery of the shroud-confronting portion 14, the inner peripheral end 25 of the seal member 24 being formed with an axially extending riser portion 36 so as to be pressed against the step 35, the riser portion 36 of the seal member 24 being pressed against the step 35 for securing. In this embodiment, the seal member 24 can be secured to the shroud-confronting portion 14 with enhanced sealability.

Figure 11:
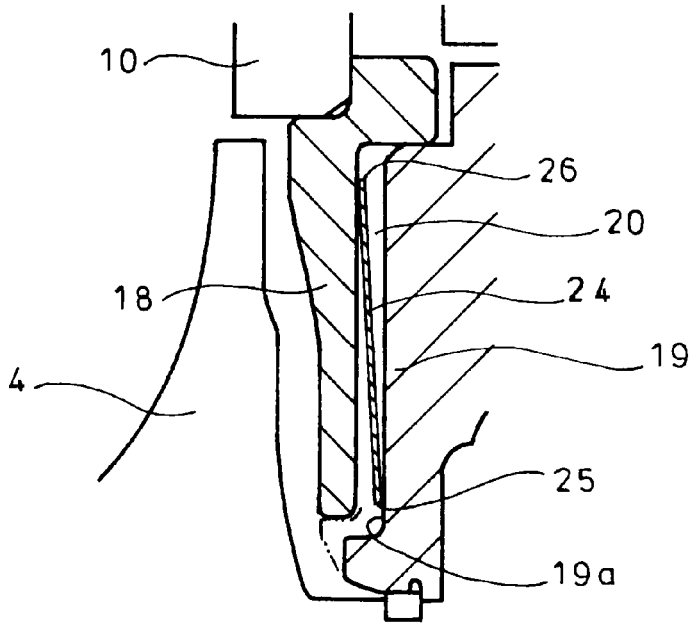
FIG. 11 is an embodiment of the invention applied to a gap between a heat shield plate (first member) and a heat-shield-plate-confronting portion (second member) in section A of the turbocharger shown in FIG. 1.

FIG. 11 shows an embodiment of the invention applied to the gap 20 formed between the heat shield plate 18 (first member) fixed to the shroud 10 and the portion 19 (second member) formed on the bearing housing 3 to confront the heat shield plate 18 in section A of the turbocharger shown in FIG. 1. In FIG. 11 embodiment, arrangement is such that the inner peripheral end 25 of the frustoconical disc spring seal member 24 made of spring material as shown in FIGS. 5 and 6 is pressed against the end face 19*a* of the heat-shield-plate-confronting portion 19, the outer peripheral end 26 of the seal member 24 being pressed against the heat shield plate 18.

According to the FIG. 11 embodiment, with the inner and outer peripheral ends 25 and 26 of the seal member 24 are pressed against the end face 19*a* of the heat-shield-plate-confronting portion 19 and the heat shield plate 18, respectively, the gap 20 is shut off so that a problem of the gas at the high-pressure-side or turbine impeller 4 leaking through the gap 15 into the low-pressure-side or bearing housing 3 can be prevented.

Figure 12:
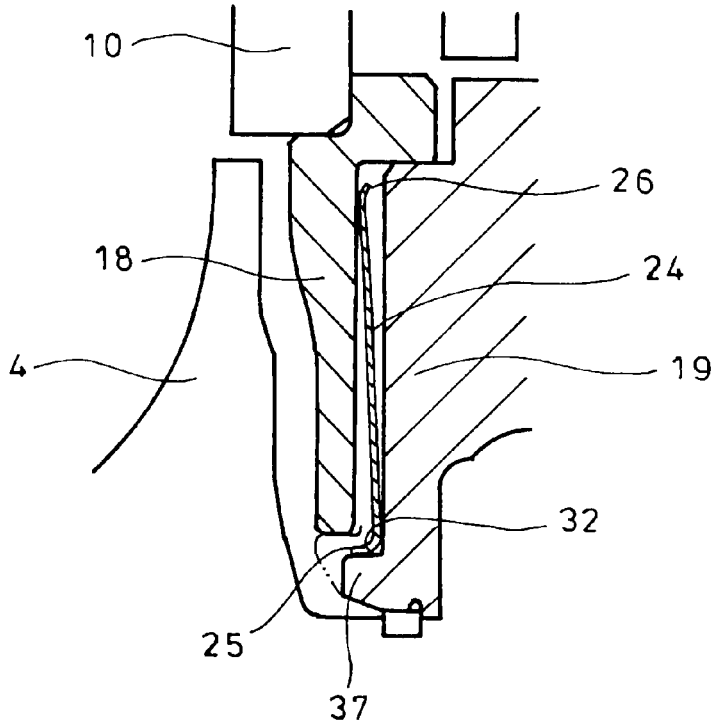
FIG. 12 is a sectional view showing a modification of the seal member shown in FIG. 11.

FIG. 12 shows a modification of the FIG. 11 embodiment in which the inner peripheral end 25 of the seal member 24 is formed with a curved portion 32 as shown in FIG. 8, the inner peripheral end 25 being pressed against an outer periphery of an annular projection 37 formed on the heat-shield-plate-confronting portion 19. In this manner, with the inner peripheral end 25 of the seal member 24 being pressed against the outer periphery of the projection 37, a problem for example upon assembling operation that the member 24 is moved to drop off from the heat-shield-plate-confronting portion 19 can be prevented.

As mentioned above, according to the turbocharger of the invention, sealing is effected such that the frustoconical disc spring seal member 24 is arranged in a pressed manner in each of the annular gaps 15 and 20 formed radially in the turbocharger so that a problem of fluid leakage through the gaps 15 and 20 can be prevented, using spring force of the disc spring seal members 24.

It is to be understood that the invention is not limited to the above embodiments and that various changes and modifications may be made without departing from the scope of the invention.

INDUSTRIAL APPLICABILITY

The invention, which can effectively prevent fluid leakage from high to low pressure sides through an annular gap formed between structural members and extending radially of a turbine shaft, is applicable to various turbochargers for enhancement of their performances.

The invention claimed is:

1. A turbocharger with a sealing device for prevention of fluid leakage from high to low pressure sides through an annular gap formed between first and second members constituting the turbocharger and extending radially of a turbine shaft, wherein said first member is a shroud fixed to a bearing housing and said second member is shroud-confronting portion formed on a turbine housing with the gap therebetween, said sealing device comprising a disc spring seal member which is frustoconical and is arranged in the gap between said shroud and shroud-confronting portion, an annular step being formed on an inner periphery of said shroud-confronting portion, a riser portion formed at the inner peripheral end of the seal member being mounted with press-in said step, and an outer peripheral end of the seal member being pressed against the shroud.

2. A turbocharger with a sealing device for prevention of fluid leakage from high to low pressure sides through an annular gap formed between first and second members constituting the turbocharger and extending radially of a turbine shaft, wherein said first and second members comprises a heat shield plate fixed to a shroud and a heat-shield-plate-confronting portion formed on a bearing housing, respectively, with the gap therebetween;

said sealing device comprises a disc spring seal member which is frustoconical and is arranged in the gap between said heat shield plate and said heat-shield-plate-confronting portion, said heat-shield-plate-confronting portion being formed with an axial annular projection to provide an annular step on a periphery of said annular projection, and a curved section formed at an inner peripheral end of the seal member is mounted with press-in said step, and an outer peripheral end of the seal member is pressed against the heat shield plate.

3. The turbocharger as claimed in claim 2, wherein the outer peripheral end of the seal member presents a curved section.

* * * * *